US011099593B2

(12) United States Patent
Gottapu et al.

(10) Patent No.: US 11,099,593 B2
(45) Date of Patent: Aug. 24, 2021

(54) BASE CURRENT CANCELLATION CIRCUIT AND METHOD THEREFOR

(71) Applicant: NXP USA, INC., Austin, TX (US)

(72) Inventors: Anil Kumar Gottapu, Vizianagaram (IN); Sanjay Kumar Wadhwa, Noida (IN); Ravi Dixit, Noida (IN)

(73) Assignee: NXP USA, INC., Austin, TX (US)

( * ) Notice: Subject to any disclaimer, the term of this patent is extended or adjusted under 35 U.S.C. 154(b) by 416 days.

(21) Appl. No.: 15/811,884

(22) Filed: Nov. 14, 2017

(65) Prior Publication Data

US 2019/0146542 A1 May 16, 2019

(51) Int. Cl.
*G05F 3/26* (2006.01)

(52) U.S. Cl.
CPC ..... *G05F 3/267* (2013.01)

(58) Field of Classification Search
CPC ..... G05F 3/267
See application file for complete search history.

(56) References Cited

U.S. PATENT DOCUMENTS

| | | | |
|---|---|---|---|
| 4,525,683 | A | 6/1985 | Jason |
| 6,956,428 | B1 | 10/2005 | Voo |
| 7,230,472 | B1 | 6/2007 | Scheuerlein et al. |
| 7,564,309 | B2 | 7/2009 | Chiu |

*Primary Examiner* — Lincoln D Donovan
*Assistant Examiner* — Colleen J O Toole

(57) ABSTRACT

An integrated circuit includes a base current cancellation circuit and a complementary to absolute temperature (CTAT) circuit. The base current cancellation circuit includes a first bipolar junction transistor (BJT) and a current mirror coupled to the first BJT. The current mirror is configured to provide a mirrored current to a base electrode of the first BJT. The CTAT circuit is coupled to receive a voltage signal corresponding to a reference current of the current mirror. The CTAT circuit includes a second BJT coupled to form a base current based on the voltage signal.

20 Claims, 3 Drawing Sheets

BASE CURRENT CANCELLATION CIRCUIT AND METHOD THEREFOR

BACKGROUND

Field

This disclosure relates generally to semiconductor devices, and more specifically, to base current cancellation circuitry in semiconductor devices.

Related Art

Today, it is important to include a stable reference voltage generator on an integrated circuit (IC) die, or chip. For example, circuits that provide a stable reference voltage are used in data converters, analog devices, sensors, and many other applications. These circuits require voltage generators that are stable over manufacturing process variations, supply voltage variations, and operating temperature variations. Such voltage generators can be implemented without modifications of conventional manufacturing processes. A bandgap reference circuit is commonly used as a stable reference voltage generator circuit. However, a bandgap reference circuit for use in low voltage, low power, and extended temperature ranges presents challenges.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

DETAILED DESCRIPTION

Bandgap voltage and current reference circuits are widely used in analog design to generate stable voltage and current references across an operating temperature range of an integrated circuit (IC) device. A temperature independent current reference can be formed by adding proportional to absolute temperature (PTAT) and complementary to absolute temperature (CTAT) currents. Generally, PTAT current is generated by using the difference between base-to-emitter voltages ($V_{BE}$) of two bipolar junction transistors (BJTs) having different current densities, while CTAT current is generated by applying $V_{BE}$ of a BJT across a resistance. These two currents are summed to generate a current with a very low temperature coefficient. In generating a CTAT current, it is assumed that the emitter current is almost equal to collector current and the base current is negligible. However, due to large base width in lateral parasitic BJTs available in today's deep submicron technologies, current gain factor β is low, typically less than 10. Thus, the base current relationship with temperature can impact the accuracy of a CTAT current.

Generally, there is provided, base current cancellation circuitry formed on a semiconductor IC that allows for a linear CTAT current relationship with temperature by minimizing effects of a non-linear base current relationship with temperature. The base current cancellation circuitry provides base current to a CTAT BJT used in generation of CTAT current rather than supplying the base current by way of a circuit branch carrying a $V_{BE}/R$ current. With the CTAT BJT base current provided by the base current cancellation circuitry, a linear CTAT current relationship can be realized at low voltage operation (e.g., 1.5 V.) and across broad temperature ranges (e.g., −40 to 150° C.).

Figure 1:
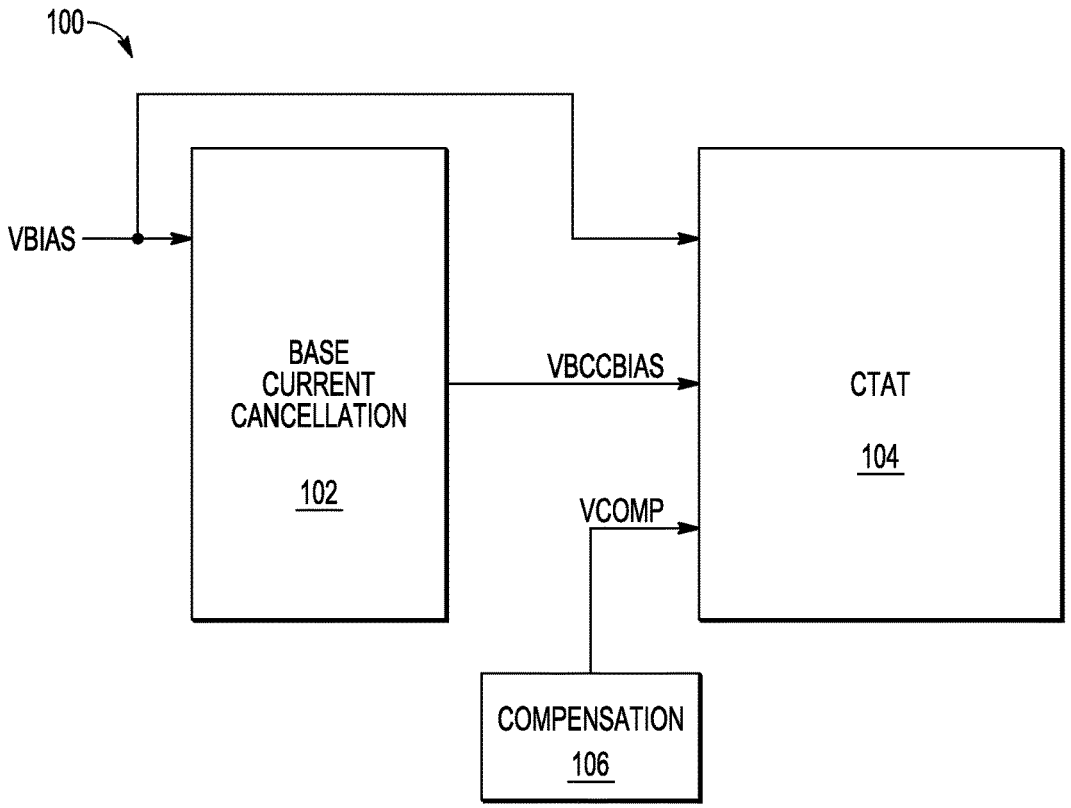
FIG. 1 illustrates, in block diagram form, exemplary complementary to absolute temperature (CTAT) current generator circuitry in accordance with an embodiment of the present invention.

FIG. 1 illustrates, in block diagram form, exemplary complementary to absolute temperature (CTAT) current generator circuitry 100 in accordance with an embodiment of the present disclosure. The CTAT current generator circuitry 100 may be suitable for low voltage operation and low power applications. The CTAT current generator circuitry 100 includes base current cancellation circuitry 102, CTAT circuitry 104, and compensation circuitry 106. CTAT circuitry 104 is generally coupled to proportional to absolute temperature (PTAT) circuitry (not shown) in a bandgap reference generator.

The base current cancellation circuitry 102 includes an input coupled to receive a bias voltage labeled VBIAS and an output coupled to provide a base current cancellation voltage signal labeled VBCCBIAS. The CTAT circuitry 104 includes a first input coupled to receive the VBIAS bias voltage, a second input coupled to receive the VBCCBIAS voltage signal, and a third input coupled to receive a compensation voltage signal labeled VCOMP. The compensation circuitry 106 includes an output for providing the VCOMP voltage signal.

Figure 2:
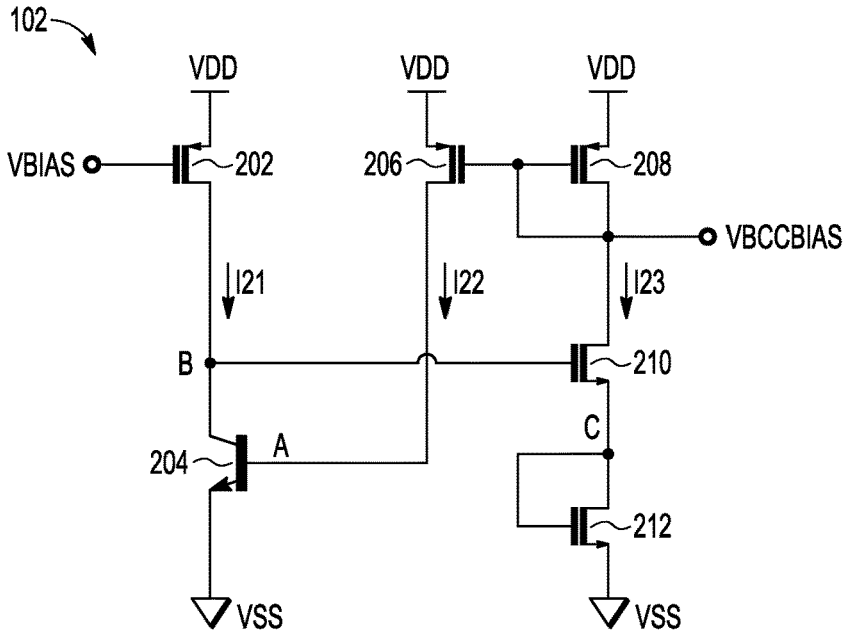
FIG. 2 illustrates, in schematic diagram form, exemplary base current cancellation circuitry in accordance with an embodiment of the present invention.

FIG. 2 illustrates, in schematic diagram form, exemplary base current cancellation circuitry 102 in accordance with an embodiment of the present disclosure. Base current cancellation circuitry 102 includes P-channel transistors 202, 206, 208, N-channel transistors 210, 212, and NPN bipolar junction transistor (BJT) 204. Base current cancellation circuitry 102 receives a bias voltage signal VBIAS an input terminal labeled VBIAS, and provides a base current cancellation voltage signal VBCCBIAS at an output terminal labeled VBCCBIAS.

A control electrode of transistor 202 is coupled to the VBIAS input terminal to receive the bias voltage signal, and a first current electrode of transistor 202 is coupled to a first voltage supply terminal labeled VDD. A second current electrode is coupled to a first current electrode (collector electrode) of transistor 204 and a control electrode of transistor 210 at node labeled B. Transistors 206 and 208 are configured to form a current mirror, and a first current electrode of each of transistors 206 and 208 is coupled to the first voltage supply terminal (VDD). A second current electrode of transistor 206 is coupled to a control electrode (base electrode) of transistor 204 at node labeled A. A second current electrode of transistor 208 is coupled to control electrodes of transistor 206 and 208, a first current electrode of transistor 210, and to the VBCCBIAS output terminal. A second current electrode of transistor 210 is coupled to a control electrode and a first current electrode of transistor 212 at node labeled C. A second current electrode (emitter electrode) of transistor 204 and a second current electrode of transistor 212 are each coupled to a second voltage supply terminal labeled VSS.

A nominal operating voltage, typically referred to as VDD, may be provided at the first voltage supply terminal. The first voltage supply terminal may also be referred to as a VDD supply terminal. The second voltage supply terminal may also be referred to as a VSS supply terminal. A 0-volt or ground voltage may be provided at the second voltage supply terminal.

In operation, transistor 202 provides a bias current I21 based on the VBIAS voltage at control electrode of transistor 202. A base current I22 of transistor 204 is provided by transistor 206 of the current mirror formed by transistors 206 and 208. Base current I22 is copied or mirrored from current I23 formed in path through transistors 208, 210, and 212. In this embodiment, transistor 210 behaves like a common gate amplifier and isolates nodes C from VBCCBIAS. Sizes of transistors 208 and 212 are chosen such that transistor 210 operates in a saturation mode. Sizes of 210 and 212 are also chosen such that a base-to-collector voltage ($V_{BC}$) of transistor 204 remains negative (e.g., voltage at node B is greater than voltage at note A) for transistor 204 to operate in an active mode. A minimum supply voltage for proper operation of the exemplary base current cancellation circuitry 102 may be determined by a maximum voltage of: base-to-emitter voltage ($V_{BE}$) of transistor 204+drain-to-source voltage ($V_{DS}$) of transistor 206, gate-to-source voltage ($V_{GS}$) of transistor 210+$V_{GS}$ of transistor 212+$V_{DS}$ of transistor 202, or $V_{GS}$ of transistor 212+$V_{GS}$ of transistor 208+$V_{DS}$ of transistor 210.

Figure 3:
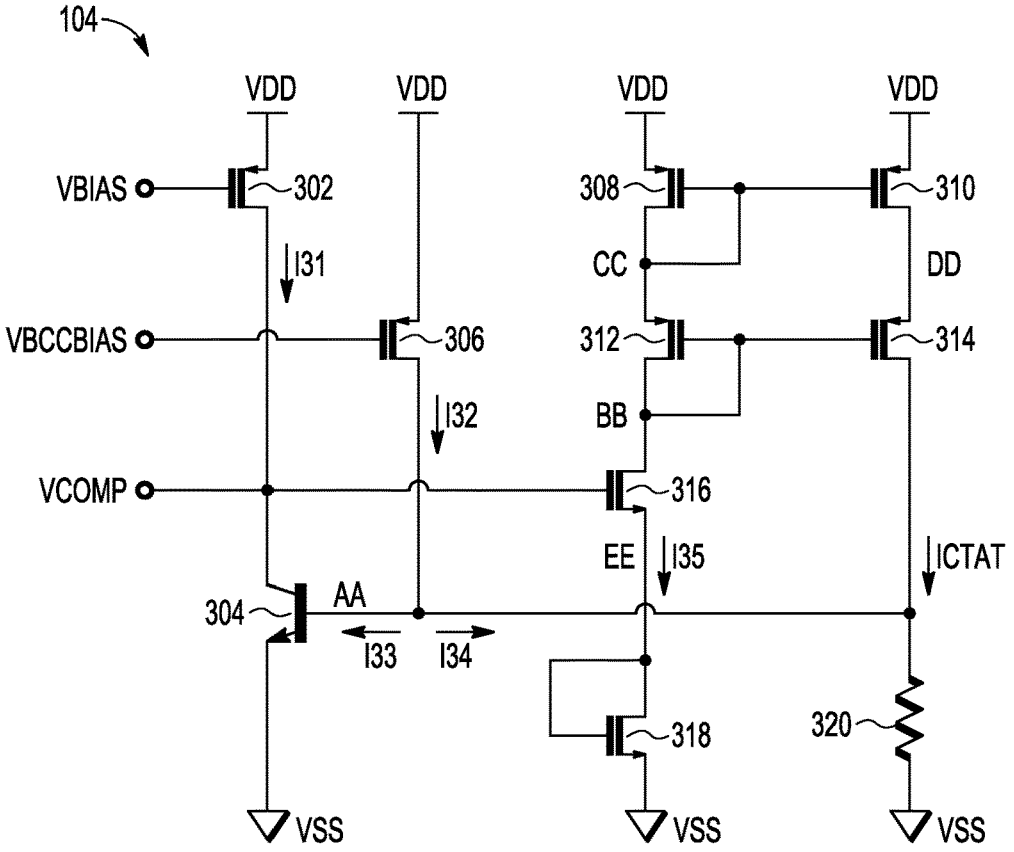
FIG. 3 illustrates, in schematic diagram form, exemplary CTAT circuitry in accordance with an embodiment of the present invention.

FIG. 3 illustrates, in schematic diagram form, exemplary CTAT circuitry 104 in accordance with an embodiment of the present disclosure. CTAT circuitry 104 includes P-channel transistors 302, 306-314, N-channel transistors 316, 318, NPN bipolar junction transistor (BJT) 304, and resistor 320. CTAT circuitry 104 receives the bias voltage signal VBIAS an input terminal labeled VBIAS, the base current cancellation voltage signal VBCCBIAS at an input terminal labeled VBCCBIAS, and a compensation voltage signal VCOMP at an input terminal labeled VCOMP.

A control electrode of transistor 302 is coupled to the VBIAS input terminal to receive the bias voltage signal VBIAS, and a first current electrode of transistor 302 is coupled to the first voltage supply terminal labeled VDD. A second current electrode is coupled to a first current electrode (collector electrode) of transistor 304 and a control electrode of transistor 316 at node coupled to input labeled VCOMP. Transistors 308-314 are configured to form a cascode current mirror, and a first current electrode of each of transistors 308 and 310 is coupled to the first voltage supply terminal (VDD). A second current electrode of transistor 308 is coupled to control electrodes of transistor 308 and 310 and a first current electrode of transistor 312 at node labeled CC. A second current electrode of transistor 310 is coupled to a first current electrode of transistor 314 at node labeled DD. A second current electrode of transistor 312 is coupled to control electrodes of transistor 312 and 314 and a first current electrode of transistor 316 at node labeled BB. A second current electrode of transistor 316 is coupled to a control electrode and a first current electrode of transistor 318, and a second current electrode of transistor 318 coupled to the second voltage supply terminal (VSS). A control electrode of transistor 306 is coupled to receive the base current cancellation voltage signal VBCCBIAS, and a first current electrode of transistor 306 is coupled to the VDD supply terminal. A second current electrode of transistor 306 is coupled to a control electrode (base electrode) of transistor 304, second current electrode of transistor 314, and a first terminal of resistor 320 at node labeled AA. A second terminal of resistor 320 is coupled to the VSS supply terminal.

In this embodiment, it is desirable for transistors 204 and 304 to be the same size. It is also desirable for transistors 206, 208, and 306, which form a current mirror, to be the same size and bias transistors 204 and 304 with a similar current, respectively. Sizes of transistors 316 and 318 are also chosen such that a $V_{BC}$ of transistor 304 remains negative (e.g., voltage at node VCOMP is greater than voltage at note AA) for transistor 304 to operate in an active mode.

In operation, transistor 302 provides a bias current I31 based on the VBIAS voltage signal at control electrode of transistor 302. Transistor 306 provides a base cancellation current I32 based on the VBCCBIAS voltage signal at control electrode of transistor 306. The cascode current mirror formed by transistors 308-314 provides reference current I35 and mirrored current ICTAT. The reference current I35 is formed with a current leg including the path through transistors 308, 312, 316, and 318. The cascode current mirror formed by transistors 308-314 helps ensure that current provided by transistor 306 is not diverted to resistor 320. Current ICTAT is mirrored from current I35 in path through transistors 308, 312, 316, and 318.

Without base current cancellation circuitry 102, ICTAT is equal to a sum of base current (I31) and current flowing through resistor 320 ($V_{BE}$/R). Accordingly, ICTAT generated without base current cancellation circuitry 102 includes non-linear base current of transistor 304 which impacts accuracy and corresponding temperature independent performance. By providing the base current I33 essentially by way of base cancellation current I32, ICTAT is substantially equal to current flowing through resistor 320, thus cancelling non-linear base current effects of transistor 304. Because base current I33 is approximately the same as base cancellation current I32, current I34 is basically negligible. In this embodiment, transistor 316 behaves like a common gate amplifier and isolates nodes BB and EE.

Figure 4:
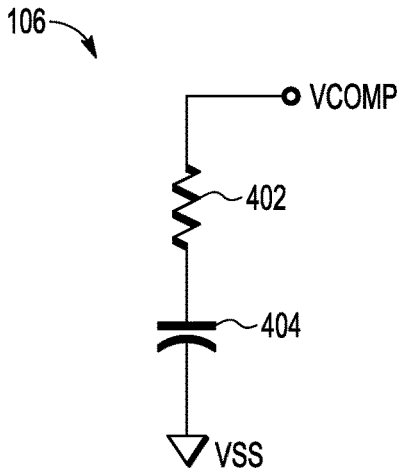
FIG. 4 illustrates, in schematic diagram form, an exemplary compensation circuit in accordance with an embodiment of the present invention.

FIG. 4 illustrates, in schematic diagram form, an exemplary compensation circuit 106 in accordance with an embodiment of the present disclosure. In this embodiment, compensation circuit 106 includes resistor 402 and capacitor 404 coupled in series. In this embodiment, compensation circuit 106 may be characterized as a pole-zero compensation network. In some embodiments, other compensation circuits may be employed. A first terminal of resistor 402 is coupled to terminal labeled VCOMP, and a second terminal of resistor 402 is coupled to a first terminal of capacitor 404. A second terminal of capacitor 404 is coupled to the VSS supply terminal. The values of resistor 402 and capacitor 404 may be chosen to achieve a desirable minimum phase margin (e.g., 62 degrees).

Figure 5:
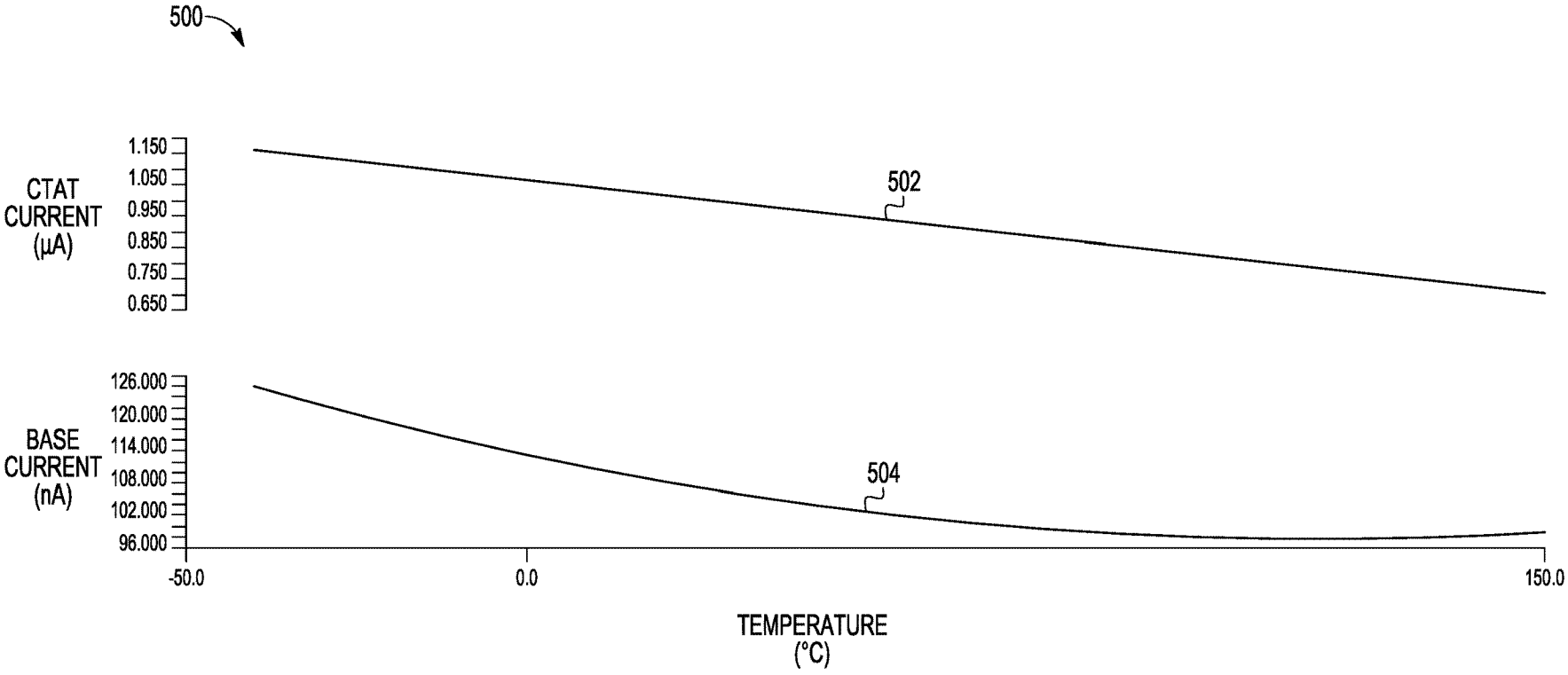
FIG. 5 illustrates, in plot diagram form, exemplary CTAT and base currents versus temperature in accordance with an embodiment of the present invention.

FIG. 5 illustrates, in plot diagram form, exemplary CTAT and base currents relationship with temperature in accordance with an embodiment of the present disclosure. Temperature values are shown in degrees Centigrade (° C.) on the X-axis, and current values are shown on the Y-axis. Plot diagram 500 of FIG. 5 includes waveforms 502 and 504 depicting simulation results of CTAT current (ICTAT) versus temperature and base current (I33) versus temperature. In this example, waveform 502 shows CTAT current ICTAT having a linear relationship with temperature while base current I33 has a non-linear relationship with temperature as shown in waveform 504. Base current cancellation circuitry 102 provides base current I32 to offset the non-linear relationship allowing ICTAT to have the linear relationship with temperature.

Generally, there is provided, an integrated circuit including a base current cancellation circuit which includes a first bipolar junction transistor (BJT), and a current mirror coupled to the first BJT, the current mirror configured to provide a mirrored current to a base electrode of the first BJT; and a complementary to absolute temperature (CTAT) circuit coupled to receive a voltage signal corresponding to a reference current of the current mirror, the CTAT circuit including a second BJT coupled to form a base current based on the voltage signal. The base current cancellation circuit may further include a reference circuit coupled to the current mirror to provide the voltage signal at an output of the base current cancellation circuit. The reference circuit may further include a first transistor having a control electrode coupled to a collector electrode of the first BJT and a first current electrode coupled to the output of the base current cancellation circuit; and a second transistor having a first current electrode and a control electrode coupled to a second current electrode of the first transistor. The current mirror may further include a first P-channel transistor having a first current electrode coupled to a first voltage supply terminal; and a second P-channel transistor having a first current electrode coupled to the first voltage supply terminal and a second current electrode coupled to a control electrode of each of the first P-channel transistor and the second P-channel transistor. The CTAT circuit may further include a third P-channel transistor having a first current electrode coupled to the first voltage supply terminal, a control electrode coupled to receive the voltage signal, and a second current electrode coupled to a base electrode of the second BJT. The CTAT circuit may further include a resistor having a first terminal coupled to the base electrode of the second BJT and a second terminal coupled to a second voltage supply terminal. The base current cancellation circuit may further include a first bias transistor having a first current electrode coupled to a collector electrode of the first BJT and a control electrode coupled to receive a bias voltage, the first bias transistor to provide a first bias current. The CTAT circuit may further include a second bias transistor having a first current electrode coupled to a collector electrode of the second BJT and a control electrode coupled to receive the bias voltage, the second bias transistor to provide a second bias current. The integrated circuit may further include a compensation circuit coupled to the collector electrode of the second BJT.

In another embodiment, there is provided, an integrated circuit including a base current cancellation circuit which include a first bipolar junction transistor (BJT), a first current mirror having a first branch and a second branch, the first branch coupled to a base electrode of the first BJT and the second branch coupled to form a reference voltage signal; and a complementary to absolute temperature (CTAT) circuit which includes a first transistor having a control electrode coupled to receive the reference voltage signal, and a second BJT having a base electrode coupled to a first current electrode of the first transistor. The first current mirror may include a first P-channel transistor having a first current electrode coupled to a first voltage supply terminal; and a second P-channel transistor having a first current electrode coupled to the first voltage supply terminal and a second current electrode coupled to a control electrode of each of the first P-channel transistor and the second P-channel transistor. The base current cancellation circuit may further include a first bias transistor having a first current electrode coupled to a collector electrode of the first BJT and a control electrode coupled to receive a bias voltage. The CTAT circuit may further include a second bias transistor having a first current electrode coupled to a collector electrode of the second BJT and a control electrode coupled to receive the bias voltage. The base current cancellation circuit may further include a reference circuit coupled to the second branch of the first current mirror to form the reference voltage signal at an output of the base current cancellation circuit. The reference circuit may further include a third transistor having a control electrode coupled to a collector electrode of the first BJT and a first current electrode coupled to the output of the base current cancellation circuit; and a fourth transistor having a first current electrode and a control electrode coupled to a second current electrode of the third transistor. The CTAT circuit may further include a second current mirror having a first branch and a second branch, the first branch coupled to a base electrode of the second BJT. The second BJT may be formed to have substantially the same size as the first BJT.

In yet another embodiment, there is provided, an integrated circuit including a first bipolar junction transistor (BJT); a first current mirror having a first branch and a second branch, the first branch coupled to a base electrode of the first BJT and the second branch coupled to a reference circuit; a first bias transistor having a control electrode coupled to receive a bias voltage and first current electrode coupled to the reference circuit and a current electrode of the first BJT; a first transistor having a control electrode coupled to the second branch and a first current electrode coupled to a first voltage supply terminal; and a second BJT having a base electrode coupled to a second current electrode of the first transistor and a current electrode coupled to a second voltage supply terminal. The reference circuit may include a second transistor having a control electrode coupled to the first current electrode of the first transistor and a first current electrode coupled to the second branch; and a third transistor having a first current electrode and a control electrode coupled to a second current electrode of the second transistor and a second current electrode coupled to the second voltage supply terminal. The first current mirror may include a first P-channel transistor in the first branch having a first current electrode coupled to the first voltage supply terminal; and a second P-channel transistor in the second branch having a first current electrode coupled to the first voltage supply terminal and a second current electrode coupled to the reference circuit and a control electrode of each of the first P-channel transistor and the second P-channel transistor.

By now it should be appreciated that there has been provided, base current cancellation circuitry formed on a semiconductor IC that allows for a linear CTAT current relationship with temperature by minimizing effects of a non-linear base current relationship with temperature. The base current cancellation circuitry provides base current to a CTAT BJT used in generation of CTAT current rather than supplying the base current by way of a circuit branch carrying a $V_{BE}/R$ current. With the CTAT BJT base current provided by the base current cancellation circuitry, a linear CTAT current relationship can be realized at low voltage operation (e.g., ≤1.5 V.) and across broad temperature ranges (e.g., −40 to 150° C.).

Because the apparatus implementing the present invention is, for the most part, composed of electronic components and circuits known to those skilled in the art, circuit details will not be explained in any greater extent than that considered necessary as illustrated above, for the understanding and appreciation of the underlying concepts of the present invention and in order not to obfuscate or distract from the teachings of the present invention.

Although the invention has been described with respect to specific conductivity types or polarity of potentials, skilled artisans appreciated that conductivity types and polarities of potentials may be reversed.

Moreover, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Architectures depicted herein are merely exemplary, and that in fact many other architectures can be implemented which achieve the same functionality. In an abstract, but still definite sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the functionality of the above described operations are merely illustrative. The functionality of multiple operations may be combined into a single operation, and/or the functionality of a single operation may be distributed in additional operations. Moreover, alternative embodiments may include multiple instances of a particular operation, and the order of operations may be altered in various other embodiments.

Although the invention is described herein with reference to specific embodiments, various modifications and changes can be made without departing from the scope of the present invention as set forth in the claims below. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims.

Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles.

Unless stated otherwise, terms such as "first" and "second" are used to arbitrarily distinguish between the elements such terms describe. Thus, these terms are not necessarily intended to indicate temporal or other prioritization of such elements.

What is claimed is:

1. An integrated circuit comprising:

a base current cancellation circuit comprising:

a first bipolar junction transistor (BJT), and a current mirror coupled to a base electrode of the first BJT, the current mirror configured to provide a mirrored current to the base electrode of the first BJT, wherein at the base electrode, only the base electrode is coupled to the current mirror; and a complementary to absolute temperature (CTAT) circuit coupled to receive a voltage signal corresponding to a reference current of the current mirror, the CTAT circuit comprising a second BJT coupled to form a base current based on the voltage signal.

2. The integrated circuit of claim 1, wherein the base current cancellation circuit further comprises a reference circuit coupled to the current mirror to provide the voltage signal at an output of the base current cancellation circuit.

3. The integrated circuit of claim 2, wherein the reference circuit further comprises:

a first transistor having a control electrode coupled to a collector electrode of the first BJT and a first current electrode coupled to the output of the base current cancellation circuit; and a second transistor having a first current electrode and a control electrode coupled to a second current electrode of the first transistor.

4. The integrated circuit of claim 1, wherein the current mirror further comprises:

a first P-channel transistor having a first current electrode coupled to a first voltage supply terminal; and a second P-channel transistor having a first current electrode coupled to the first voltage supply terminal and a second current electrode coupled to a control electrode of each of the first P-channel transistor and the second P-channel transistor.

5. The integrated circuit of claim 4, wherein the CTAT circuit further comprises a third P-channel transistor having a first current electrode coupled to the first voltage supply terminal, a control electrode coupled to receive the voltage signal, and a second current electrode coupled to a base electrode of the second BJT.

6. The integrated circuit of claim 5, wherein the CTAT circuit further comprises a resistor having a first terminal coupled to the base electrode of the second BJT and a second terminal coupled to a second voltage supply terminal.

7. The integrated circuit of claim 1, wherein the base current cancellation circuit further comprises a first bias transistor having a first current electrode coupled to a collector electrode of the first BJT and a control electrode coupled to receive a bias voltage, the first bias transistor to provide a first bias current.

8. The integrated circuit of claim 7, wherein the CTAT circuit further comprises a second bias transistor having a first current electrode coupled to a collector electrode of the second BJT and a control electrode coupled to receive the bias voltage, the second bias transistor to provide a second bias current.

9. The integrated circuit of claim 1, further comprising a compensation circuit coupled to a collector electrode of the second BJT.

10. An integrated circuit comprising:

a base current cancellation circuit comprising:

a first bipolar junction transistor (BJT), a first current mirror having a first branch and a second branch, the first branch coupled to a base electrode of the first BJT and the second branch coupled to form a reference voltage signal, wherein at the base electrode, only the base electrode is coupled to the first current mirror; and a complementary to absolute temperature (CTAT) circuit comprising:

a first transistor having a control electrode coupled to receive the reference voltage signal, and a second BJT having a base electrode coupled to a first current electrode of the first transistor.

11. The integrated circuit of claim 10, wherein the first current mirror comprises:

a first P-channel transistor having a first current electrode coupled to a first voltage supply terminal; and a second P-channel transistor having a first current electrode coupled to the first voltage supply terminal and a second current electrode coupled to a control electrode of each of the first P-channel transistor and the second P-channel transistor.

12. The integrated circuit of claim 10, wherein the base current cancellation circuit further comprises a first bias transistor having a first current electrode coupled to a collector electrode of the first BJT and a control electrode coupled to receive a bias voltage.

13. The integrated circuit of claim 12, wherein the CTAT circuit further comprises a second bias transistor having a first current electrode coupled to a collector electrode of the second BJT and a control electrode coupled to receive the bias voltage.

14. The integrated circuit of claim 10, wherein the base current cancellation circuit further comprises a reference circuit coupled to the second branch of the first current mirror to form the reference voltage signal at an output of the base current cancellation circuit.

15. The integrated circuit of claim 14, wherein the reference circuit further comprises:

a third transistor having a control electrode coupled to a collector electrode of the first BJT and a first current electrode coupled to the output of the base current cancellation circuit; and a fourth transistor having a first current electrode and a control electrode coupled to a second current electrode of the third transistor.

16. The integrated circuit of claim 10, wherein the CTAT circuit further comprises a second current mirror having a first branch and a second branch, the first branch coupled to a base electrode of the second BJT.

17. The integrated circuit of claim 10, wherein the second BJT is formed to have substantially the same size as the first BJT.

18. An integrated circuit comprising:

a first bipolar junction transistor (BJT);

a first current mirror having a first branch and a second branch, the first branch coupled to a base electrode of the first BJT and the second branch coupled to a reference circuit, wherein at the base electrode, only the base electrode is coupled to the first current mirror;

a first bias transistor having a control electrode coupled to receive a bias voltage and first current electrode coupled to the reference circuit and a current electrode of the first BJT;

a first transistor having a control electrode coupled to the second branch and a first current electrode coupled to a first voltage supply terminal; and a second BJT having a base electrode coupled to a second current electrode of the first transistor and a current electrode coupled to a second voltage supply terminal.

19. The integrated circuit of claim 18, wherein the reference circuit comprises:

a second transistor having a control electrode coupled to the first current electrode of the first transistor and a first current electrode coupled to the second branch; and a third transistor having a first current electrode and a control electrode coupled to a second current electrode of the second transistor and a second current electrode coupled to the second voltage supply terminal.

20. The integrated circuit of claim 18, wherein the first current mirror comprises:

a first P-channel transistor in the first branch having a first current electrode coupled to the first voltage supply terminal; and a second P-channel transistor in the second branch having a first current electrode coupled to the first voltage supply terminal and a second current electrode coupled to the reference circuit and a control electrode of each of the first P-channel transistor and the second P-channel transistor.

* * * * *